US005437384A

United States Patent [19]

Farrell

[11] Patent Number: 5,437,384

[45] Date of Patent: Aug. 1, 1995

[54] CONTAINER APPARATUS FOR FLUID MATERIAL

[76] Inventor: Peter J. Farrell, 72 Bushey Way, Beckenham, Kent, United Kingdom, BR3 2TD

[21] Appl. No.: 72,181

[22] Filed: Jun. 3, 1993

[30] Foreign Application Priority Data

Jun. 5, 1992 [GB] United Kingdom ..... 9212032

[51] Int. Cl.[6] ..... B65D 88/20

[52] U.S. Cl. ..... 220/1.5; 220/404; 220/401; 220/9.2; 220/6

[58] Field of Search ..... 141/114, 314, 316, 390, 141/391; 248/95, 99, 100, 101; 220/6, 7, 4.16, 4.33, 1.5, 9.1, 9.2, 9.3.403, 404, 401, 400, 402, 666, 668

[56] References Cited

U.S. PATENT DOCUMENTS

| | | | |
|---|---|---|---|
| 2,638,951 | 5/1953 | Smith et al. | 220/9.2 |
| 3,746,240 | 7/1973 | Flynn | 220/403 |
| 4,934,636 | 6/1990 | Orlosky | 248/95 |
| 5,217,132 | 6/1993 | Looker | 220/1.5 |

FOREIGN PATENT DOCUMENTS

| | | | |
|---|---|---|---|
| 1038808 | 9/1978 | Canada | 220/403 |
| 4128181 | 4/1992 | Japan | 220/404 |
| 2189773 | 11/1987 | United Kingdom . | |
| 2248225 | 4/1992 | United Kingdom | 220/404 |
| 2250976 | 6/1992 | United Kingdom | 220/404 |

*Primary Examiner*—S. Castellano
*Attorney, Agent, or Firm*—Iandiorio & Teska

[57] ABSTRACT

Container apparatus (2) for transporting and storing fluid material, comprising a flexible bag (8), a rigid frame member (10) which is attached to an upper portion of the flexible bag (8), a rigid base (12), and elongate support members (16) which are positioned outside the flexible bag (8) and which are movable from a first position in which they extend between the rigid frame member (10) and the rigid base (12), to a second position in which they allow the sides of the flexible bag (8) to collapse, and the container apparatus being characterized in that the rigid frame member (10) is provided with inboard portions (13) which are attached to the sides (9) of the flexible bag (8) thereby to draw the sides of the flexible bag substantially inboard of the rigid base and force the fluid material towards corners of the flexible bag which are formed by points of attachment of the flexible bag to corners of the rigid frame member and to create an upper portion to the flexible bag which has opposing sides which are inclined toward each other in order progressively to reduce the volume for a liner bag (6) to occupy as it is filled, and characterized in that the container apparatus is free of constraint members which extend parallel to the rigid base to constrain the sides of the flexible bag.

8 Claims, 6 Drawing Sheets

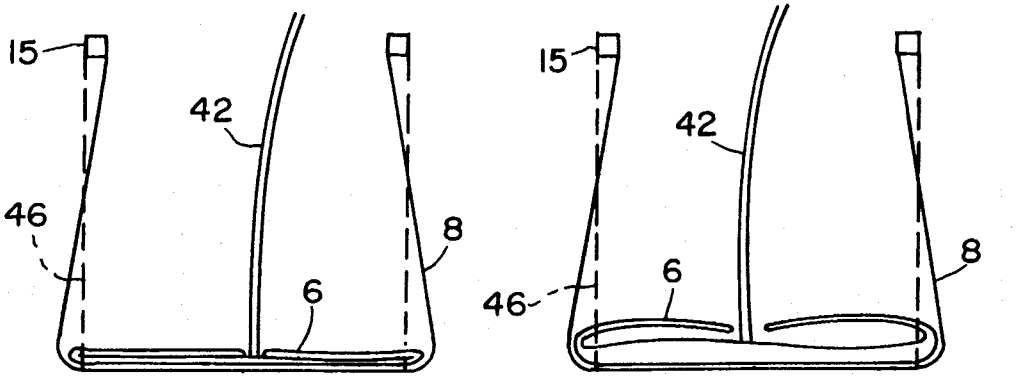
FIG. 5a
FIG. 5b
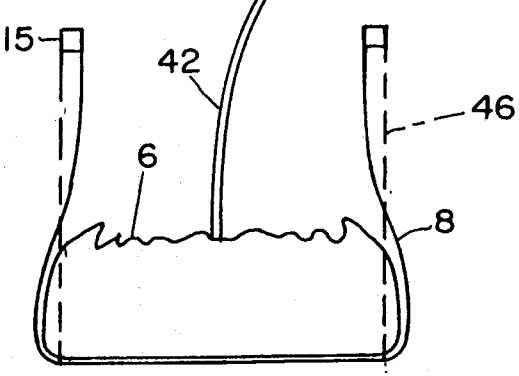
FIG. 5c
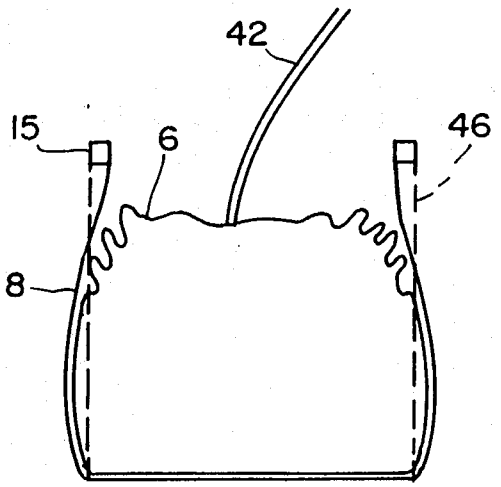
FIG. 5d
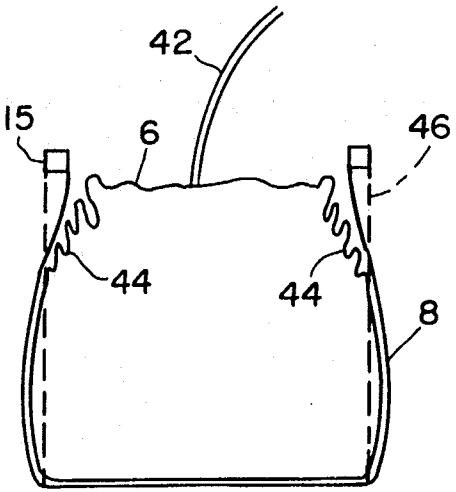
FIG. 5e
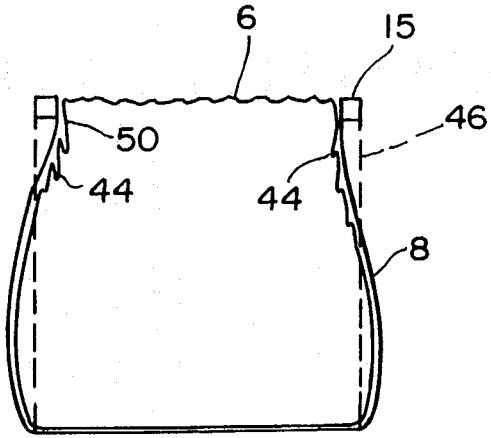
FIG. 5f

CONTAINER APPARATUS FOR FLUID MATERIAL

This invention relates to container apparatus for fluid material and, more especially, this invention relates to collapsible container apparatus for transporting and storing fluid material such as liquids, powders and granular materials.

There are many known types of containers for transporting and storing fluid materials. Many of the known containers are not collapsible which means that the cost of returning the empty unit is often uneconomic. Most known collapsible containers which have been designed to solve this problem incorporate expensive mechanisms to permit them to be collapsed whilst retaining sufficient strength. Also, the operations of erecting and collapsing the containers are too complicated and take too long, or use too many people to be attractive alternatives to the non-collapsible type of container. Most collapsible containers require a separate disposable liner bag. A further problem found with collapsible containers that require an internal disposable liner bag, is that during the filling operation, the liner bag needs a considerable amount of manual assistance to open out evenly without trapping folds. If the folds are left trapped, they have the effect of reducing the capacity of the container.

UK Patent No. 2189773B describes container apparatus which is collapsible, returnable and cost effective. In addition, the container apparatus has been well received by users. Whilst the container apparatus described in UK patent No. 2189773B has found favour with many customers, it shares with other types of collapsible container, three disadvantages described above, namely that it is too heavy for one person to erect or collapse, it is expensive, and manual unfolding of the liner is necessary. The container apparatus also suffers from the disadvantage that when the flexible bag is hoisted to bring the valve to the lowest point for drainage, the valve moves to a central point above the rigid base, making it impossible to dispense fluid material directly into a static vessel such as a bucket adjacent to the container apparatus.

It is an aim of the present invention to provide container apparatus which is collapsible and which eliminates or reduces the disadvantages mentioned above.

According to this invention, there is provided container apparatus for transporting and storing fluid material, which container apparatus comprises a flexible bag, a rigid frame member which is attached to an upper portion of the flexible bag, a rigid base, and elongate support members which are positioned outside the flexible bag, the elongate support members being such that they are movable from a first position in which they extend between the rigid frame member and the rigid base to hold the rigid frame member firm with respect to the rigid base, to a second position in which they allow the sides of the flexible bag to collapse by folding when the flexible bag does not contain the fluid material, and the container apparatus being characterised in that the rigid frame member is provided with inboard portions which are inboard of the elongate support members and which are attached to the sides of the flexible bag thereby to draw the sides of the flexible bag substantially inboard of the rigid base, the inboard portions being formed by four elongate members which define four corners, the four corners each including a diagonal portion which extends towards and engages an upper portion of one of the elongate support members when the elongate support members are in their second position So that the corners of the rigid frame member cause the fluid material during filling to be forced towards corners of the flexible bag which are formed by points of attachment of the flexible bag to the corners of the rigid frame member, and the inboard portions causing the upper portions of the flexible bag to have opposing sides which are inclined towards each other in order progressively to reduce the volume for a liner bag to occupy as it is filled thereby to obviate the need for manual adjustment of the liner bag during filling of the container apparatus with the fluid material, characterised in that the container apparatus is free of constraint members which extend parallel to the rigid base to constrain the sides of the flexible bag, and characterised in that the container apparatus includes raising means for inclining a base of the flexible bag to facilitate drainage.

The container apparatus of the present invention can be used for transporting and storing fluid materials, such as liquids, powders, particulate materials and small food products such as peas and peanuts. Generally the container apparatus can be used for transporting and storing any material that is able to flow. The rigid base facilitates the handling of the container apparatus by forklift trucks. The elongate support members can, if desired, be secured by hinge means to the rigid base in order to remove the danger of losing them which would render the container apparatus useless. The rigid frame member and rigid base allow the container apparatus to be stacked irrespective of whether the elongate support members are in the first position in which the container apparatus can be full or the second position in which the container apparatus is empty. During transport of the container apparatus, sideways forces may be encountered, for example in vehicles travelling around corners or braking sharply. The elongate support members are then effective to hold the rigid frame member firm with respect to the rigid base and thus to stop any tendency for the container apparatus to adopt the form of a parallelogram. The need for cleaning and sterilising between each use can be avoided by employing either a disposable liner bag which is changed before each use or by employing a reusable liner bag and dedicating the container to a single product with which the container can be repeatedly filled without prior cleaning.

The rigid frame member employed in the container apparatus of the present invention has the dual role of firstly ensuring that the flexible bag does not bulge excessively when the container apparatus is full with fluid material in spite of the absence of constraint members extending parallel to the rigid base, and secondly allowing the liner bag to unfold completely without manual assistance owing to the narrow upper portion of the flexible bag provided by the shape of the rigid frame member compared with lower parts of the flexible bag. The automatic unfolding of the liner advantageously saves labour costs because there is no need for constant supervision and manual adjustment of the liner bag during the filling operation to remove trapped folds.

The container apparatus may be one in which the rigid frame member has a square or rectangular part which is attached to the flexible bag. In such an embodiment of the invention, the upper portion of the flexible bag may be gathered at the corners to provide additional material at the corners below the rigid frame member to allow bulging at the corners in response to pressure from the fluid material. Alteratively, the flexible bag can be manufactured with a built-in taper towards the top of the corners to achieve the same effect. The flexible bag is also preferably tapered towards its base. In order to maximise the volume which can be filled within a given volume occupied by the container apparatus as a whole, the flexible bag is preferably progressively wider towards the upper half and gathered in or tapered at the upper corners to fit the rigid frame member. This gives a compact and surprisingly flat-sided appearance to the flexible bag when full and, furthermore, the bulging is constrained without the need for expensive and heavy constraint members extending parallel to the rigid base. It also allows the liner bag to unfold naturally and to fill the entire volume of the container apparatus without manual assistance.

The flexible bag can be directly attached to the rigid frame member, for example, by means of rivets, screws, bolts or other fastener means.

Usually the rigid top portion will have an access opening for inserting a liner bag for filling and for extracting the liner bag after use.

In order to monitor the level of contents, the flexible bag may be provided with a sight window made of a translucent or transparent material. The sight window may be made of a single large piece of the translucent or transparent material extending from a point near the top of the flexible bag to a point near the bottom of the flexible bag.

Usually the flexible bag will include an outlet aperture. Advantageously, the outlet aperture will correspond with a recessed portion in the rigid base so that, if desired, a valve can be fitted to a liner outlet gland on the liner bag before filling the container apparatus. This simplifies the emptying operation as the recipient of the filled container apparatus does not have to insert a type of valve which uses complicated means to prevent leaking of the fluid material during the operation of fitting the valve to the gland. In this embodiment of the invention, the recipient of the filled container apparatus simply attaches a hose to the valve and opens the valve to evacuate the container apparatus of fluid material.

If desired, the container apparatus may be used without a liner bag. In this case, a valve may be fitted directly to the outlet aperture.

Preferably the valve is secured so that it does not swing during transport, thus causing fatigue to the liner bag and risking rupture of the liner bag. Another benefit of securing the valve is that if force is needed to open the valve, this can be applied to a handle on the valve without twisting the valve. However, in transport, the flexible bag may have a tendency to move up and down, and in this event, a completely rigid valve would be likely to rupture the liner bag. The means of securing the valve, therefore, is preferably a bracket which enables the valve to swivel up and down by rotating about a point towards the front portion of the valve so that the back of the valve, which is attached to the liner bag, can move up and down. This may be achieved by providing horizontal pivoting points either side of the valve so that rotation of the valve is in a vertical plane.

If desired, the valve can be protected by a guard having a moveable flap which can be secured in a vertical position in front of the valve.

Usually, the container apparatus will include a lifting mechanism for raising a side of the flexible bag to facilitate drainage. The lifting mechanism may comprise a ratchet and a strap, with the ratchet attached to a part of the frame member which is diagonally opposite the outlet aperture, and one end of the strap may be connected to the ratchet and the other end of the strap connected to a stiffener bar which is attached to a flat member positioned under the flexible bag which, at its other extremity, is attached to the rigid base either side of the outlet aperture. The ratchet is for tensioning the strap so that one end of the flat member can be raised whilst the opposite end of the flat member which is adjacent to the outlet aperture, remains secured to the rigid base. The base of the flexible bag, which rests on the flat member is inclined by the flat member, leaving the outlet aperture at the lowest point to facilitate drainage. The outlet aperture remains static during this operation so that it is possible to dispense the fluid material directly into an adjacent vessel without spilling it onto the rigid base. If preferred, the flexible bag can be attached to the flat member to prevent it from slipping down the inclined plane, in which case the point of attachment will preferably be close to the extremity of the flat member to which the stiffener bar is attached.

Preferably the rigid base will be in the form of a pallet. Usually the pallet will have entry points for tines of fork lift trucks.

The container apparatus may be one in which the rigid frame member includes a lid. The rigid frame member may be provided with means to fasten a separate lid. Alternatively a hinged lid may be employed with appropriate locking means. Either type of lid will usually contain means to attach a tamper-evident device which may be, for example, a wire with a lead seal which is necessarily broken if the lid is opened.

The container apparatus may be one in which there is one of the elongate support members adjacent each corner of the rigid base.

Each elongate support member may comprise first and second parts which are separable from each other.

The first part may be pivotable about hinge means on the rigid base such that in one position it lies along an edge of an upper surface of the rigid base.

The container apparatus may be one in which the second part is shorter than the first part and is rigidly attached to the rigid frame member, the second part being of a length which allows the flexible bag to collapse by folding and which forms a support leg extending between the rigid frame member and the rigid base in the collapsed condition of the flexible bag, whereby the container apparatus can be stacked with other container apparatus of the same design without the weight of the stacked container apparatus pressing on the flexible bag or the pivoted first parts of the elongate support members.

The container apparatus may be one in which the first and second parts abut against each other and are held in position by a spigot attached to an open end of one of the abutting parts and extending into an open end of the other abutting part in the erected condition of the flexible bag. If desired the spigot can be held captive in the first parts of the elongate support members, for example, by a spring loaded pin or a separate locking pin. This prevents the first and second parts separating if the container apparatus is accidentally knocked onto its side.

The external dimension of the second part may be a loose fit in a hole provided in the rigid base to prevent jamming of the container apparatus when it is in its collapsed condition if the rigid base becomes distorted through use. A tab will usually be fitted to the side of each second part to bear on an upper surface of the rigid base to limit penetration of the second part into the rigid base.

The liner bag can be filled by a flexible hose which passes through the access opening. Alternatively the liner bag can be filled from the bottom using the valve which also serves for emptying the container apparatus. The access opening may be a complete opening defined by the shape of the rigid frame member.

If desired, the access opening may be closed by a flap or a plurality of overlapping flaps to help constrain the liner bag in the event of fluid material expanding due to heat or chemical reaction. The overlapping flaps may be attached to each other using detachable fastener means. The flaps may be attached to a filling gland in the top of the liner bag. The flaps may be used instead of a rigid lid or in conjunction with a rigid lid.

The container apparatus of the present invention may be manufactured and sold with or without the liner bag.

The container apparatus may be made of any desired materials. For example, the flexible bag may be made of a fabric material. Preferred fabric materials are non-elastic woven fabric materials such as polyester which are coated, for example, with polyvinyl chloride to prevent ingress of dirt or fluid material into the interstices of the weave. The rigid frame member and elongate support members may be made of metal. Mild steel which is zinc plated or galvanised may be used or stainless steel if preferred by the industry using the container apparatus. The rigid base may be of the same material as the elongate support members, or it may be made of wood or a plastics material. The liner bag will usually be made of a plastics material, for example, low density polyethylene, nylon, or a combination of such materials if the liner bag is disposable. If the liner bag is reusable, it may be made of a coated fabric similar to that of the flexible bag. A metalised film can be used in the liner bag to reduce oxygen penetration. Usually the liner bag will comprise several layers.

Embodiments of the invention will now be described solely by way of example and with reference to the accompanying drawings in which:

FIG. 5 illustrates the filling of a liner bag in the container apparatus of the present invention.

Figure 1:
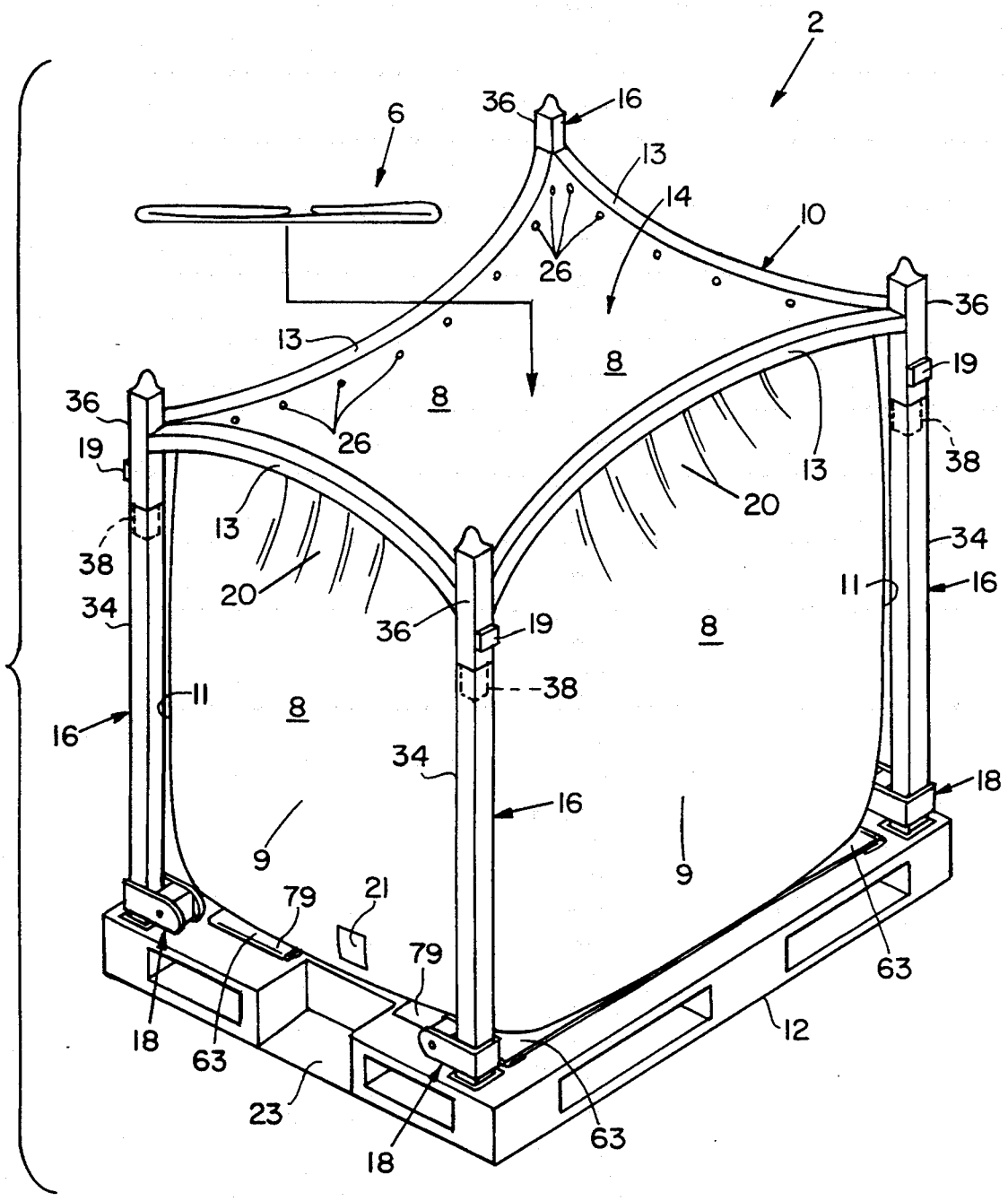
FIG. 1 is a perspective view of first container apparatus of the present invention in an erected condition.

Referring to FIG. 1, there is shown container apparatus 2 for transporting and storing fluid material. The container apparatus 2 comprises a flexible bag 8 which supports a liner bag 6 for containing fluid material. The flexible bag 8 has an access opening 14.

The container apparatus 2 also comprises a rigid frame member 10 which is attached to an upper portion of the flexible bag 8. The container apparatus 2 further comprises a rigid base 12, and elongate support members 16 which are positioned outside the flexible bag 8.

The elongate support members 16 are such that they are movable about hinge means 18 which are such as to secure the elongate support members 16 to the rigid base 12. The elongate support members 16 are movable from a first position in which they extend between the rigid frame member 10 and the rigid base 12 to hold the rigid frame member 10 firm with respect to the rigid base 12, to second position in which they allow the flexible bag 8 to collapse by folding when not containing fluid material.

The flexible bag 8 is kept substantially inboard of the rigid base 12 by virtue of the shape and size of the rigid frame member 10 and the positioning of the points of attachment 26 of the rigid frame member 10 to the flexible bag 8. The points of attachment are such that those parts of the flexible bag 8 around the centre of each side 9 which have the greatest tendency to bulge, are drawn inwards owing to the formation of a neck portion 20 and those parts which have the least tendency to bulge, around the corners 11, are allowed to move outwards owing to the provision of an amount of flexible bag material at these points in addition to that required by the size of the rigid frame member.

The opposing sides of the upper portion 20 of the flexible bag 8 are inclined towards each other so that in the final stages of filling the container apparatus 2 there is sufficient loose liner bag material to bridge the distance across the top of the flexible bag 8 without the liner bag 6 becoming taut, which would reduce the capacity of the container apparatus 2.

The flexible bag 8 includes an aperture 2I, into which is provided discharge means such as a valve 54 (see FIG. 3) which is held by a bracket 55 which enables the valve 54 to pivot in sympathy with vertical movement of the flexible bag 8 during transport when the container apparatus 2 is full. A recess 23 is provided in the rigid base 12 to house the valve 54. The recess 23 may be provided with a lip 57 to contain drips after the container has been emptied. It may also be provided with a hinged guard 59 provided with locking means 61, to protect the valve.

In order to empty residues in the container apparatus, a lifting mechanism is provided. The lifting mechanism comprises a ratchet 71 which is attached to the rigid frame member 10 at a point diagonally opposite the aperture 21, and a strap 69 which connects the ratchet 71 to a rigid stiffening member 67 enclosed in a loop 65 in a flat member 63. The fiat member 63 lies under the flexible bag 8 and is attached to the rigid base 12 either side of the aperture 21. When the container apparatus 2 is nearly empty, final drainage is achieved by operating the ratchet 71 which tensions the strap 69 thereby lifting one extremity of the flat member 63 and inclining the flexible bag 8 which rests on it. The points of attachment 79 of the flat member 63 to the rigid base 12 are positioned each side of the outlet aperture 21 such as to raise the flexible bag 8 to form a slight funnel 73 in the flexible bag 8 and to encourage the fluid material to flow towards the outlet aperture 21.

The flexible bag 8 is made of a material which cannot be seen through. In order to be able clearly to monitor the level of contents of the container apparatus 2, a window 75 may be provided which is preferably a single large panel and this may be made of a material that is sufficiently clear to show the fluid material but also strong enough to fulfill the function containment safely.

As can be seen from FIGS. 1, 2, 3 and 4 the rigid base is in the form of a pallet.

Figure 2:
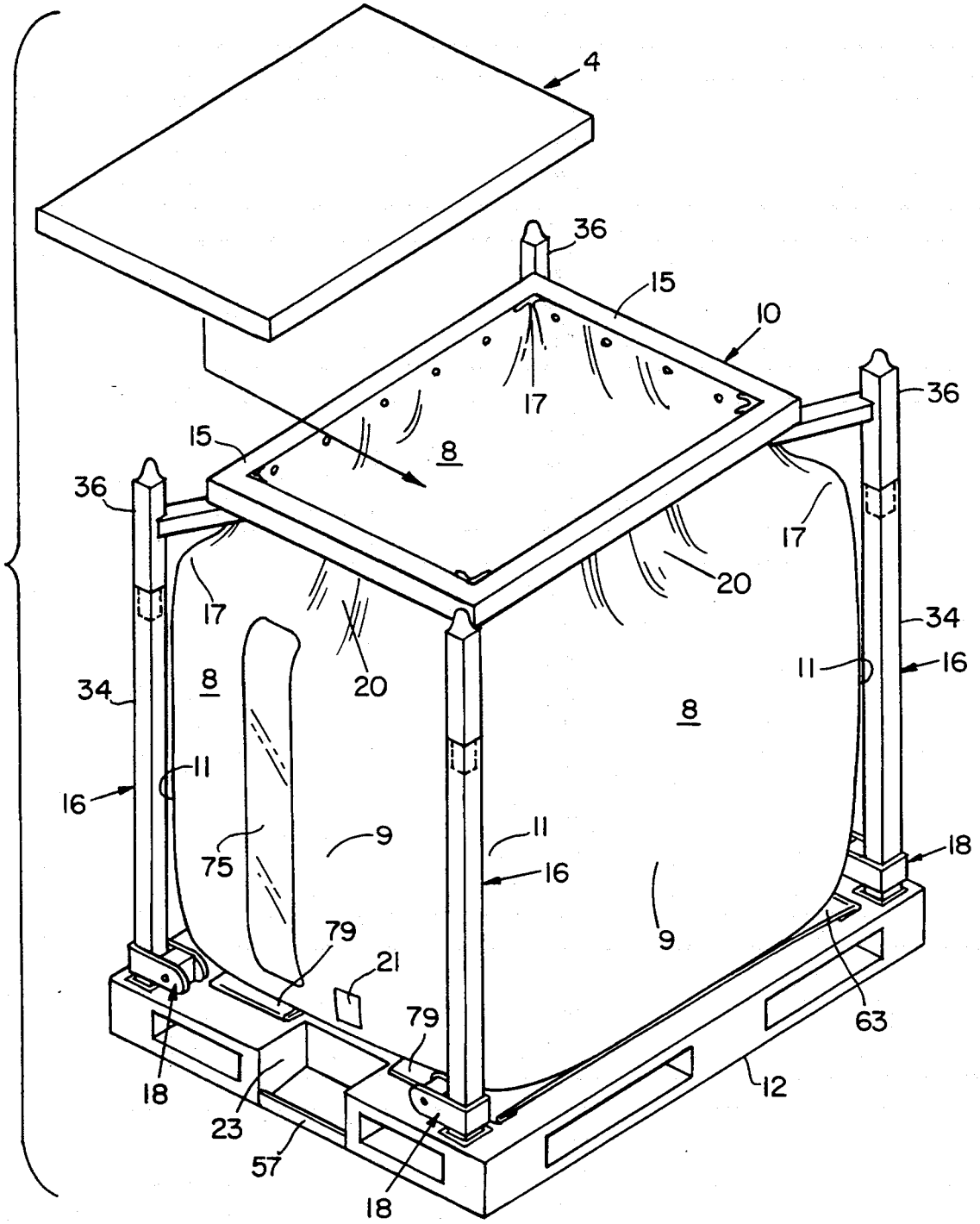
FIG. 2 is a perspective view of a second container apparatus with a straight sided rigid frame member and lid.

Curved portions 13 of the rigid frame member 10 in FIG. 1 are replaced in FIG. 2 by straight sides 15 in order to facilitate manufacture both of the rigid frame member 10 and the lid 4. However, the principle of drawing the centre part of each side 9 of the flexible bag 8 inwards whilst allowing the corners 11 to bulge outwards is still achieved because the top of the flexible bag 8 is gathered at all four corners and pressure of fluid material forces the corners outwards at a point 17 immediately below the rigid frame member 10.

As can be seen from FIGS. 1, 2, 3 and 4, each elongate support member 16 comprises a first part 34 and a second part 36. The first part 34 and the second part 36 are separable from each other.

If desired, the two parts 34, 36 may be secured together by a securing device to prevent accidental separation, in the case, for example, of the container apparatus 2 falling over. The securing device will preferably be self-locking when the container apparatus 2 is assembled and will preferably not contain any loose parts. The securing device may consist of a spring loaded pin in the form of a loop 77 held captive in the first part 34. The action of inserting the spigot portion 38 of the second part 36 into the first part 34 compresses the spring until the second part is fully home and abuts the first part, at which point the position of the pin corresponds with a hole (not shown) in the spigot portion 38 of the second part 36 and the spring forces the pin into the hole.

Figure 4:
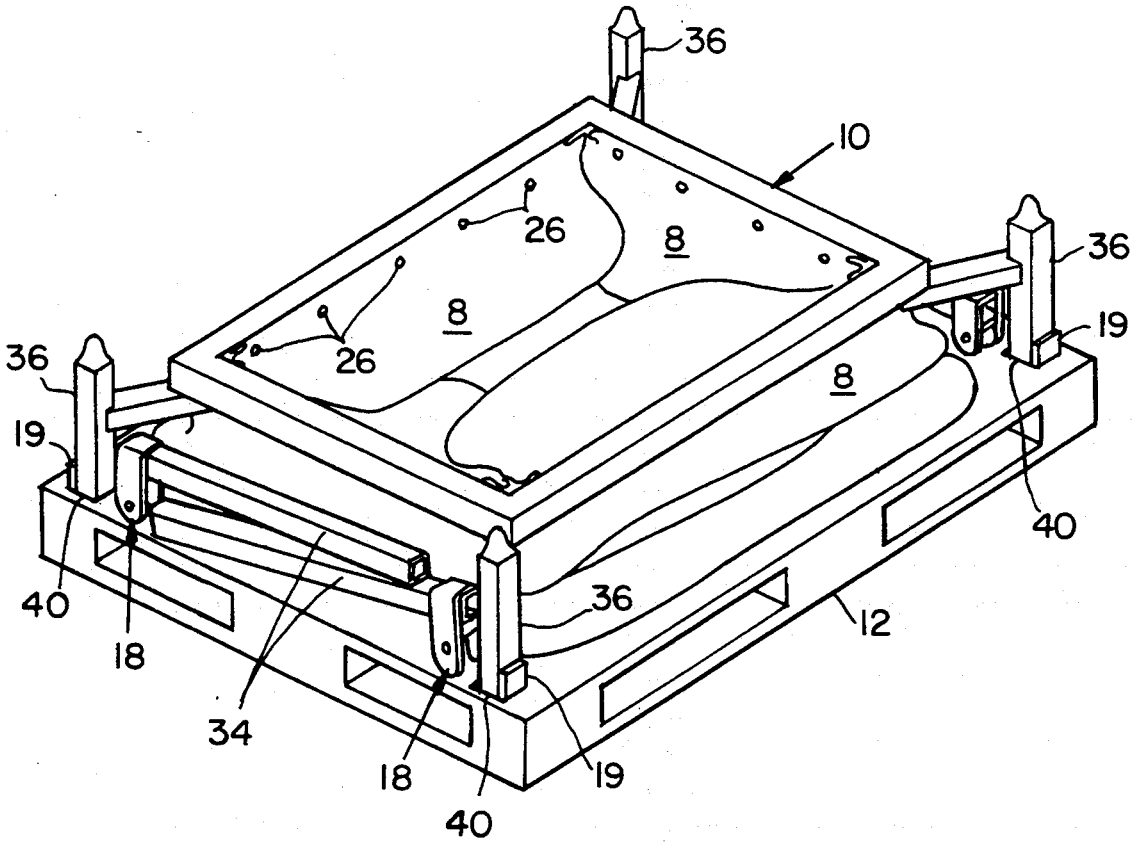
FIG. 4 is a perspective view of the container apparatus shown in FIG. 2 but in a collapsed condition.
Figure 6A:
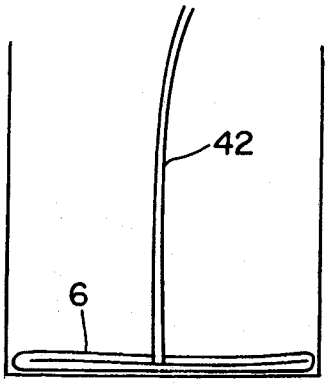
FIG. 6a Prior Art
FIG. 6 illustrates the filling of a liner bag in collapsible container apparatus of known conventional design.
Figure 6B:
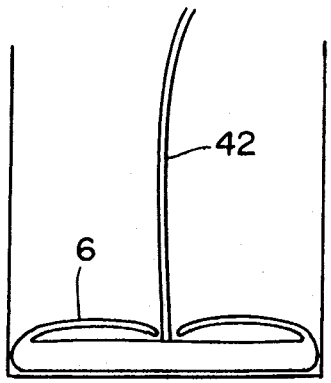
FIG. 6b Prior Art
Figure 6C:
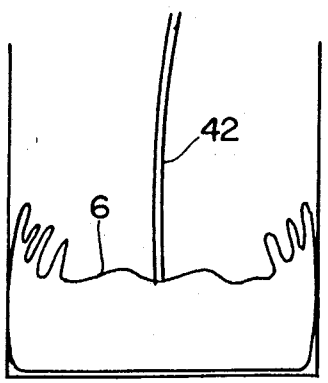
FIG. 6c Prior Art
Figure 6D:
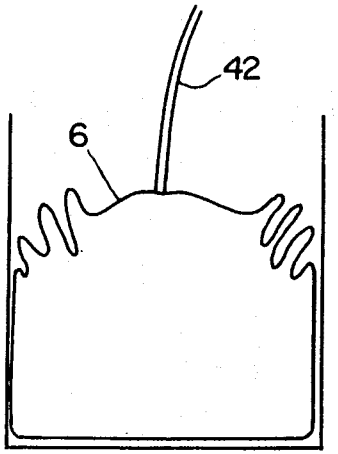
FIG. 6d Prior Art
Figure 6E:
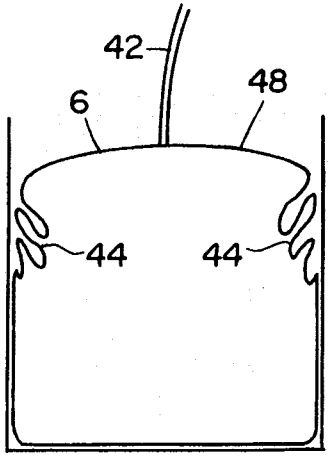
FIG. 6e Prior Art
Figure 6F:
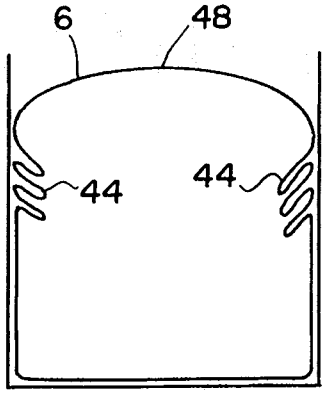
FIG. 6f Prior Art

The first part 34 is pivotable about the rigid base 12 such that in the pivoted position shown in FIG. 4, the first part 34 lies along an edge of an upper surface of the rigid base 12.

Figure 3:
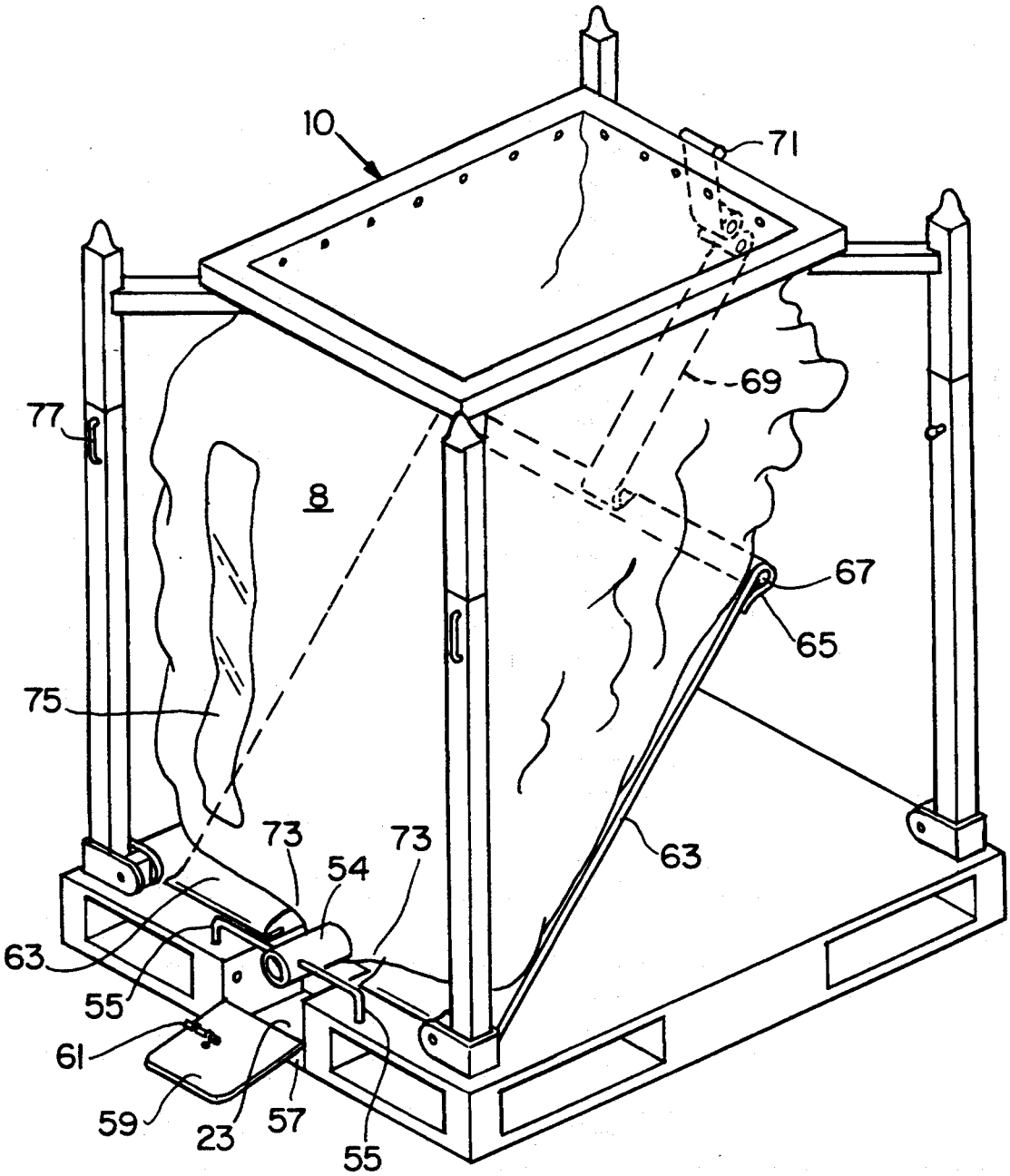
FIG. 3 is a perspective view of the container apparatus shown in FIG. 2 but in the final stages of emptying with a strap tensioned by a ratchet.

The second part 36 is shorter than the first part 34 and it is rigidly fixed to the rigid frame member 10. The second part 36 is of a length which allows the flexible bag 8 to collapse and forms a support leg extending between the rigid frame member 10 and the rigid base 12 in the collapsed condition of the flexible bag 8. This position is shown in FIG. 3 and it will be seen that the container apparatus 2 can be stacked with the second part 36 supporting the weight of the container apparatus above. As can be seen from FIG. 3, both the spigot portions 38 and a small amount of the second part part 36 fit in recesses 40 in the rigid base 12 and they are prevented from falling beyond a certain point by a tab 19. The recesses 40 are of a larger internal size than the external size of the second part 36 so that in the collapsed condition of the container apparatus, the second part 36 is a loose fit in the recesses 40 and will not become jammed in the rigid base 12 even if, over time, some distortion to the rigid base occurs.

In the erected condition of the container apparatus 2, the first and second parts 34 and 36 abut against each other. They are held in position by the spigot portion 38 on each second part 36. The spigot portion 38 on each second part 36 extends into its adjacent first part 34. This is because the first part 34 is in the form of a hollow tube. In the collapsed condition of the container apparatus 2 as shown in FIG. 4, the liner bag 6 has been omitted for ease of illustration.

FIG. 5 shows how a liner bag 6 unfolds during filling with the fluid material, FIG. 5*a* indicating the first stage of filling with a filling pipe 42 and FIG. 5*f* indicating the final filled stage of the liner bag 6. It is to be appreciated that the liner bag 6 is of a flat pillow or satchet shaped construction, which is folded in a special way when empty and which is designed to unfold according to a pre-determined pattern during the filling operation.

FIG. 6 shows a similar filling operation with a liner bag 6 in container apparatus shown in UK Patent No. 2189773B. It will be seen from FIGS. 6*e* and 6*f* how the liner bag 6 becomes constrained in its opening behaviour by trapped folds 44 which prevent the complete volume of the outer container from being filled.

For simplicity of comparison between FIGS. 5 and 6, a dotted line 46 has been shown in FIG. 5*a* and this dotted line shows the area taken up by the liner bag 6 of the same type shown in FIG. 6 and occupying the same volume as the liner bag 6 shown in FIG. 5. The liner bag 6 shown in FIG. 5 unfolds automatically without the need for manual adjustment. In contrast, the liner bag 6 shown in FIG. 6 needs manual adjustment at several stages of filling especially during the second half of the operation, in order to eliminate trapped folds 44 which will prevent the full volume from being delivered. One considerable disadvantage of the trapped folds 44 can be appreciated from FIGS. 6*e* and 6*f* wherein it will be seen that the bag has a distended portion 48. If filling is continued under pressure without manual assistance to release the distended portion 48, the liner bag 6 is in danger of bursting before the full volume has been delivered. As can be seen from FIGS. 5*e* and 5*f*, although there are some minor trapped folds 44, the liner bag 6, because it narrows at a neck portion 50 (corresponding to the neck portion 20 in the flexible bag 8), is able to fill completely and occupy all the desired available space in the flexible bag 8.

It is to be appreciated that the embodiments of the invention described above with reference to the accompanying drawings have been given by way of example only and that modifications may be effected. Thus, for example, the illustrated hinges 18 may be replaced by a different mechanism or removed altogether if loose elongate support members are desired. Also, the liner bag 6 may be omitted and the fluid material placed directly in the flexible bag 8. In such an embodiment of the invention the outlet aperture is omitted or a valve is fitted within the outlet aperture.

I claim:

1. Container apparatus for transporting and storing fluid material, which container apparatus comprises a flexible bag having opposed sidewalls, corners and an upper portion with sides, a liner bag within said flexible bag, a rigid frame member which is attached to said upper portion of the flexible bag, a rigid base, and elongate support members which are positioned outside the flexible bag, the elongate support members being such that they are moveable from a first position in which they extend between the rigid frame member in the rigid base to hold the rigid frame member firm with respect to the rigid base, to a second position in which they allow the sides of the flexible bag to collapse by folding when the flexible bag does not contain the fluid material, and the container apparatus being characterized in that the rigid frame member is provided with inboard portions which are attached to the sides of the said upper portion of the flexible bag thereby to draw the sides of the flexible bag substantially inboard of the rigid base, the inboard portions having corners which are adjacent upper portions of the elongate support members when the elongate support members are in their first position so that the corners of the inboard portions of the rigid frame member cause the fluid material during filling to be forced toward the corners of the flexible bag which are attached by points of attachment of the flexible bag to the corners of the inboard portions of the rigid frame member, the inboard portions causing the upper portion of the flexible bag to have opposing sidewalls which are inclined towards each other in order progressively to reduce the perimetric area of the flexible bag as the liner bag is filled thereby to eliminate the need for manual adjustment, which would be necessary if the opposing sidewalls were parallel, of the liner bag during filling of the container apparatus with the fluid material, characterized in that the container apparatus is free of constraint members which extend parallel to the rigid base, and characterized in that the container apparatus includes a flat member which is attached to the rigid base at one extremity and which is positioned under the flexible bag and to which raising means is attached at the other extremity, the raising means being such as to move the flat member to a raised position thus inclining the base of the flexible bag to facilitate drainage.

2. Container apparatus according to claim 1 in which the rigid frame member has a four sided rectilinear part which is attached to the flexible bag.

3. Container apparatus according to claim 1 in which the flexible bag is tapered towards its base.

4. Container apparatus according to claim 1 in which the flexible bag is made of a material which cannot be seen through, and in which the flexible bag includes a sight window made from a material through which the fluid material can be seen in order to monitor the level of the fluid material in the container apparatus.

5. Container apparatus according to claim 1 in which the rigid base has a recessed portion for receiving a valve which is attached to a liner outlet gland.

6. Container apparatus for transporting and storing fluid material, which container apparatus comprises a flexible bag having opposed sidewalls, corners and an upper portion with sides, a liner bag within said flexible bag, a rigid frame member which is attached to said upper portion of the flexible bag, a rigid base, and elongate support members which are positioned outside the flexible bag, the elongate support members being such that they are moveable from a first position in which they extend between the rigid frame member and the rigid base to hold the rigid frame member firm with respect to the rigid base, to a second position which they allow the sides of the flexible bag to collapse by folding when the flexible bag does not contain the fluid material, and the container apparatus being characterized in that the rigid frame member is provided with inboard portions which are attached to the sides of the said upper portion of the flexible bag thereby to draw the sides of the flexible bag substantially inboard of the rigid base, the inboard portions having corners which are adjacent upper portions of the elongate support members when the elongate support members are in their said first position so that the corners of the inboard portions of the rigid frame member cause the fluid material during filling to be forced towards the corners of the flexible bag which are attached by points of attachment of the flexible bag to the corners of the inboard portions of the rigid frame member, the inboard portions causing the upper portion of the flexible bag to have the opposing sidewalls which are inclined towards each other in order progressively to reduce the perimetric area of the flexible bag as the liner bag is filled thereby to eliminate the need for manual adjustment, which would be necessary if the opposing sidewalls were parallel, of the liner bag during filling of the container apparatus with the fluid material, characterized in that the container apparatus is free of constraint members which extend parallel to the rigid base, and characterized in that the rigid base has a recessed portion for receiving a valve which is attached to a liner outlet gland, and the container apparatus including a bracket which permits a swivelling motion of the valve in synchronous motion with vertical movement of the flexible bag during transport.

7. Container apparatus according to claim 1 in which the elongate support members each comprise first and second parts, and in which the second part of each one of said elongate support members is of a smaller external dimension than a corresponding hole in the rigid base such as to allow a loose fit of the second part in the said corresponding hole when the support members are in said second position.

8. Container apparatus according to claim 1 in which the elongate support members each comprise first and second parts, and in which the first and the second parts are secured to each other in the erected condition of the container apparatus by a spring loaded lock.

* * * * *